United States Patent [19]

Hasegawa

[11] 4,084,524

[45] Apr. 18, 1978

[54] TWO-STEP BUTTONHOLE MECHANISM FOR SEWING MACHINE

[75] Inventor: Syoogo Hasegawa, Ibaragi, Japan

[73] Assignee: White Sewing Machine Company, Cleveland, Ohio

[21] Appl. No.: 718,808

[22] Filed: Aug. 30, 1976

[30] Foreign Application Priority Data

Sep. 11, 1975 Japan ..... 50-127557[U]

[51] Int. Cl.[2] ..... D05B 3/02

[52] U.S. Cl. ..... 112/158 B

[58] Field of Search ..... 112/158 B, 158 A, 158 R

[56] References Cited

U.S. PATENT DOCUMENTS

| | | | |
|---|---|---|---|
| 3,148,645 | 9/1964 | Aiki et al. | 112/158 B |
| 3,149,591 | 9/1964 | Aiki et al. | 112/158 B |
| 3,754,521 | 8/1973 | Thuring | 112/158 B |

*Primary Examiner*—Werner H. Schroeder
*Assistant Examiner*—Peter Nerbun
*Attorney, Agent, or Firm*—McNenny, Pearne, Gordon, Gail, Dickinson & Schiller

[57] ABSTRACT

A device in a domestic sewing machine for semiautomatic sewing of buttonholes which comprises a bank of cams for controlling lateral needle oscillation, needle position or base line, and work feed. The cams are manually set in two successive steps, each followed by sewing of one end of the buttonhole and then one side of the buttonhole. The cams, as well as a ratchet wheel, are fixed to a common shaft to enable the ratchet wheel to rotationally displace the cams and thereby effect a change in the sewing pattern from end stitching to side stitching after formation of a fixed number of end stitches.

5 Claims, 5 Drawing Figures

Fig. 3
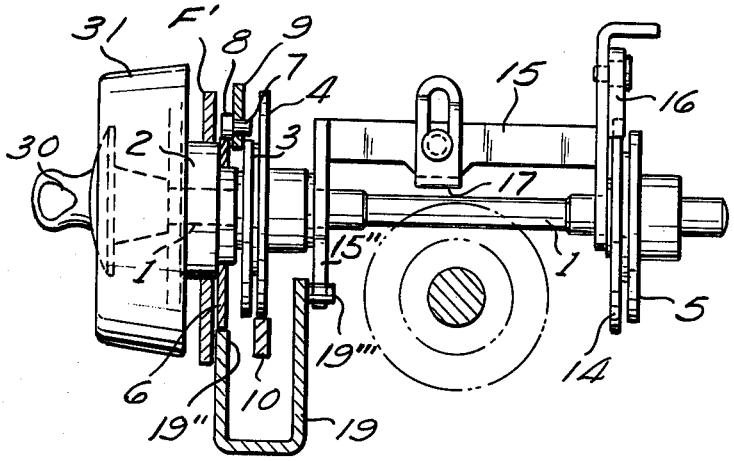
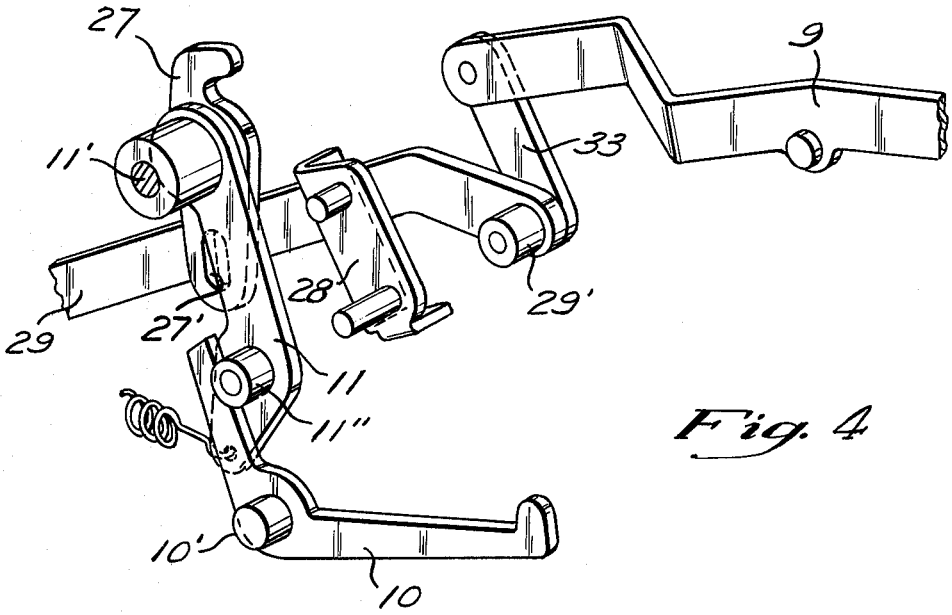
Fig. 4
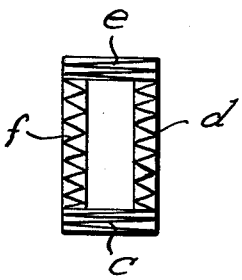
Fig. 5

TWO-STEP BUTTONHOLE MECHANISM FOR SEWING MACHINE

BACKGROUND OF THE INVENTION

The invention relates to sewing machines and, in particular, to a mechanism for sewing buttonholes.

PRIOR ART

Domestic sewing machines in the past have incorporated devices to carry out the sewing of buttonhole stitch patterns. Examples of such devices are disclosed, for example, in U.S. Pat. Nos. 3,090,334; 3,131,658; 3,148,645; 3,149,591; and 3,670,676. It is known from certain ones of these patents to produce a buttonhole stitch pattern by sewing a rectangular buttonhole outline in successive steps by combining end bar stitches of wide amplitude and limited feed and side stitches of slightly less than half amplitude and moderate feed. It is also known from particular ones of the aforementioned patents to control the stitching pattern and sequence by a bank of cams incrementally rotatable about a common axis and controlling the lateral stitch amplitude, base line or lateral offset of the stitching zone, and the combination of feed direction and rate. In general, devices of the general type under consideration here have suffered from disadvantages, such as excessive machine complexity and the requirement of high operator dexterity, concentration, and intervention throughout the sewing sequence.

SUMMARY OF THE INVENTION

The invention provides a device for performing a semiautomatic buttonhole sewing sequence that is characterized by a high degree of operator convenience and by limited reliance on an operator's skill and experience. In accordance with the invention, cams controlling the needle amplitude and lateral position, as well as work feed, are properly conditioned by manually setting an associated control dial at only two steps in the sequence, each of such steps being followed by the automatic sewing of one-half of the buttonhole.

More specifically, in an initial step, the control cams are set at an appropriate angular position by manual rotation of a knob on an exterior face of the machine. The device is at first effective to generate and to count out through a ratchet wheel a fixed number of bar stitches forming the end segment of the buttonhole. The bar stitches as produced by the control cams are characterized by a large lateral amplitude and minimal feed. Upon reaching the final bar stitch number, and while sewing motion continues, a transition is automatically accomplished by the control cams for the sewing of a side of the buttonhole. Side stitches are characterized by a reduced amplitude and a moderate feed pattern. When the side of the buttonhole reaches the desired length, sewing is terminated by the machine operator. After this point, the control knob is turned to a second angular position to reset the cams and ratchet counting wheel. Sewing is again started with the control cams governing the production of the second set of bar end stitches and side stitches in essentially the same manner as that just described.

BRIEF DESCRIPTION OF THE DRAWINGS

FIG. 3 is a cross sectional view of the mechanism of FIGS. 1 and 2, taken along the direction of the upper shaft of the sewing machine;

FIG. 4 is an exploded, perspective view of a limited area of the device of FIGS. 1 and 2, illustrating details of the connection of various link elements; and FIG. 5 is a diagrammatic representation of the sewing pattern of a buttonhole produced by the disclosed device.

DESCRIPTION OF THE PREFERRED EMBODIMENT

Figures 1, 2:
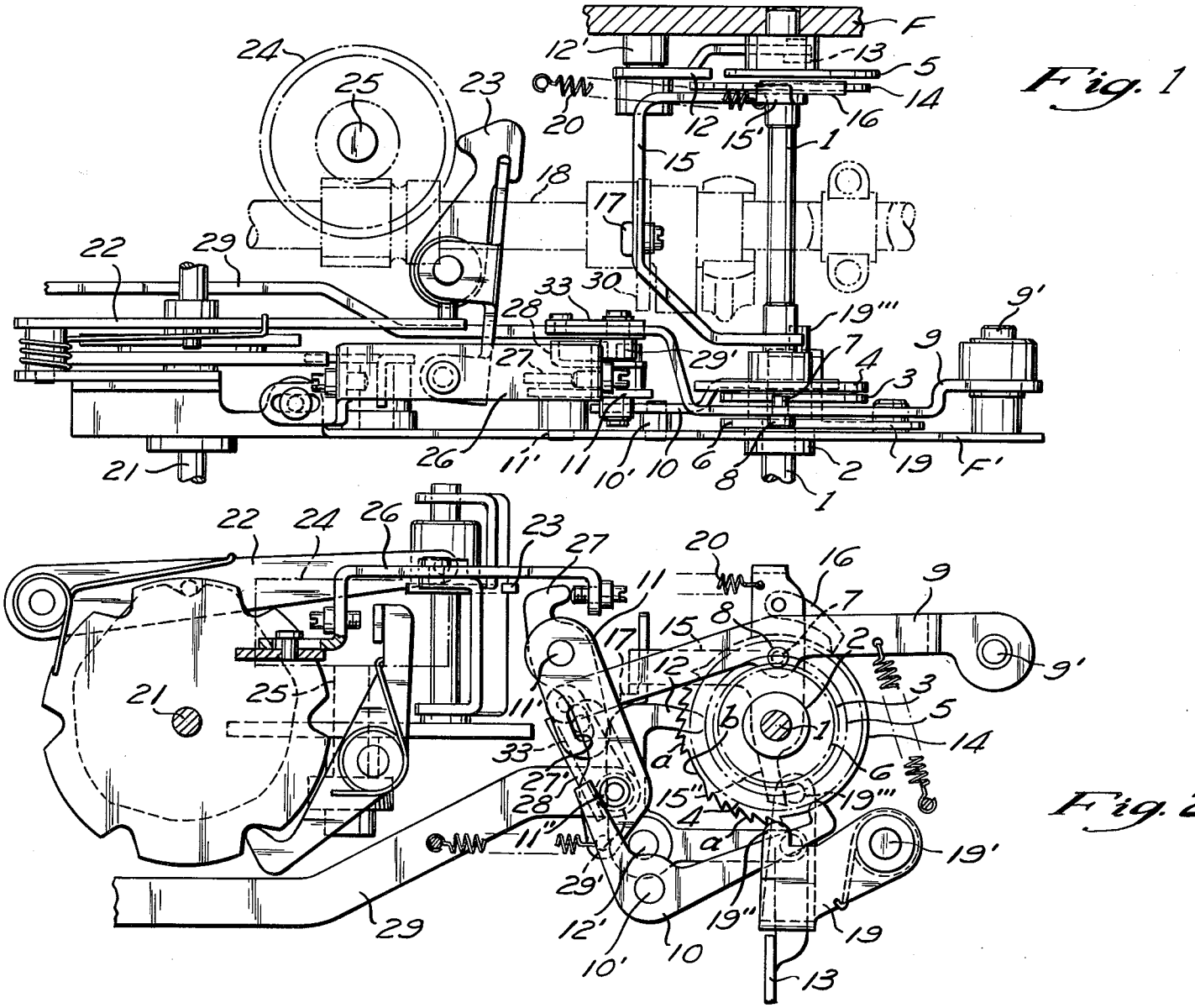
FIG. 1 is a plan view of a buttonhole sewing mechanism constructed in accordance with the principles of the present invention.
FIG. 2 is an elevational view of the mechanism of FIG. 1.

Referring to the drawings, there is shown a device employed in a conventional domestic zig-zag sewing machine for the semiautomatic sewing of buttonholes.

An operating shaft 1 for buttonhole sewing is supported in a freely rotatable manner in the axial core of a tubular shaped amplitude regulating or operating shaft 2. The amplitude shaft 2 is freely rotatably journaled on an installation plate F'. The operating shaft 1 extends through the upper portion of the front of the frame of the zig-zag sewing machine, and is fixed to a manually engageable control knob 30 exposed on the front face of the machine. The rear end of the shaft 1 is rotationally freely supported in the rear portion of the frame F. The hollow amplitude shaft 2 similarly extends through the front installation plate F' and has an annular, manually engageable control knob 31 fixed thereon. In order from the front, an amplitude changing cam 3, a base line changing cam 4, and a forward or feed changing cam 5 are fixed to the aforementioned buttonhole sewing operating shaft 1 and have suitable high and low positions which are required for buttonhole sewing.

Moreover, a typical amplitude changing cam 6 of the zig-zag sewing machine is fixed to the inner edge of the aforementioned amplitude regulating or operating shaft 2. A contact or cam follower element 7 contacts the amplitude changing cam 3 for buttonhole sewing. Along with a contact or follower element 8, which contacts the amplitude changing cam 6 of the aforementioned zig-zag sewing machine, this contact element 7 is installed on an amplitude changing lever 9 of the zig-zag sewing machine, which has a fulcrum shaft 9'.

A contact element or cam follower 10 has a fulcrum shaft 10' and an end which contacts the base line changing cam 4 from below for buttonhole sewing. This contact element has its other end contacting a base line changing lever 11 of the zig-zag sewing machine, which has a fulcrum shaft 11'. A contact element or cam follower 12 has a fulcrum shaft 12' and an end which contacts the aforementioned forward or feed changing cam 5 from the side, and whose other end is connected with a forward or feed changing rod 13, which is connected with a conventional cloth forwarding or feeding adjustment mechanism (not shown) of the sewing machine.

A ratchet wheel 14 has gear or toothed surface portions *a* each comprising a number of teeth which are equal (six teeth) to the number of stitches (six stitches) of lock sewing constituting the sewing of both ends of the buttonhole. Intermediate the toothed portions *a* is a smooth or nontoothed portion *b*. The ratchet wheel 14 is fixed to the aforementioned buttonhole sewing shaft 1 along with the aforementioned three cams 3, 4, and 5.

A generally U-shaped oscillating arm 15 is supported by pivoting the bases of both of its ends, each formed in the shape of a hook, on the bottonhole sewing operating shaft 1. The arm 15, at the top portion 15' of one of its bases, has a forwarding claw or pawl 16 which contacts the aforementioned ratchet wheel 14. A cam 30 is positioned below a contact part 17 provided at the tip of the arm 15 and fixed on the upper shaft 18 of the sewing machine.

The arm 15 is made to touch one end 19''' of a stopper 19 whose other end 19'' is made to touch the aforementioned amplitude changing cam 6 of the zig-zag sewing machine. The stopper has a fulcrum shaft 19' and ordinarily (i.e., when not sewing buttonholes) causes the contact portion 17 of the arm 15 to escape outside the rotary orbit of the aforementioned cam 30. In addition, the aforementioned stopper 19 releases the engagement of the aforementioned oscillating arm 15, thereby causing the said contact portion 17 to interfere inside the orbit of the cam 30 when one end 19' falls to the low position of the same cam 6 and the other end 19''' is elevated in conformity with repositioning of the amplitude setting shaft 2 through manual engagement of the knob 31 at the time of use in connection with buttonhole sewing, which turns the aforementioned amplitude bearing cam 6 counterclockwise in FIG. 2. A return spring 20 is provided between the aforementioned oscillating arm 15 and frame F.

FIGS. 1 and 2 disclose in a generally conventional arrangement a pattern selection operating shaft 21 of the sewing machine, a pattern selection lever 22, a pattern selection contact element 23, a pattern cam 24, a pattern camshaft 25 which moves in conjunction with the aforementioned shaft 18, a connecting rod 26 which transmits the zig-zag producing movement of the pattern selection contact element 23, a lever 27 which transmits the movement of said connecting lever 26, an oscillating case 28 whose tip is fixed to the oblong hole 27' at the tip of the lever 27 and whose base is pivoted to the aforementioned base line changing lever 11, respectively. An amplitude operating lever 29 has a rotary element 29' at its tip, being engaged under bias of a spring (not shown) to the side surface of the oscillating case 28 and the other end being connected to the needle bar. A link 33 connects the amplitude changing lever 9 with the end of the amplitude operating lever carrying the rotary element 29'.

In addition, FIG. 5 shows a sketch of buttonhole sewing. In this figure, *c* shows sewing of bar lock stitches on the front end, *d* shows sewing at the right edge, *e* shows sewing of bar lock stitches at the rear end, and *f* shows left edge sewing.

Next, an explanation will be made regarding the use of the apparatus described above.

First, the pattern selection operating shaft 21 of the sewing machine is manually placed at the zig-zag straight line sewing position and, likewise, the amplitude regulating or operating shaft is rotated by a fixed angle toward the left from the amplitude zero position. As a result, the amplitude changing cam 6 at the inner end of the operating shaft 2 is rotated, the tip of the amplitude changing lever 9 is slightly raised through the contact element 8, thereby causing the axial center of the rotary element 29' at the tip of the amplitude operating lever to become separated slightly from the pivotal axial center of the oscillating case 28 and, at the same time, the tip of the stopper 19 is elevated as stated earlier, the engagement of the oscillating arm 15 is released, and the contact portion 17 of the arm 15 is made to interfere inside the rotary orbit of the cam 30.

Next, the buttonhole sewing operating shaft 1 is rotated 90 degrees in the clockwise direction of FIG. 2. As a consequence, the three cams 3, 4, and 5, which are fixed to the shaft 1, operate respectively with the result that the contact elements 7, 10, and 12, which contact the said cams, are pushed upwardly, i.e., radially outwardly, and the amplitude changing lever 9, which is connected to the cam 3, is changed to the amplitude maximum position, the base line changing lever 11 is changed to the right base line position, and the forwarding changing rod is changed to the backward position where the amount of movement is minimal, or approximately zero.

At the same time, the ratchet wheel 14, also fixed to the shaft 1, is rotated and causes the front edge of the tooth surface portion *a* having six teeth to be engaged with the forwarding claw 16.

After this manual step for buttonhole sewing has been completed in the manner described above, the sewing machine is operated. Thereupon, for each rotation of the upper shaft 18, the cam 30 pushes up the contact element 17 and the oscillating arm 15, through the forwarding claw 16, moves the ratchet wheel 14 one tooth at a time, with the result that the lock sewing on the front side buttonhole which is shown in FIG. 5 is carried out.

As stated above, when the first toothed surface part *a* of the ratchet wheel is driven beyond the action position of the forwarding claw 16 and the nontoothed part *b* is engaged by the claw or pawl, the rotation of the wheel 14 is terminated and at this same time the amplitude changing cam 3 and the forwarding changing cam 5 are designed to work, thereby operating the respective contact elements 7 and 12, and, with the right base line as it is, changing the amplitude changing lever 9 to the position where the amplitude is smaller and changing the forward changing arm 13 to the position where the amount of backward movement is medium, respectively, thereby effecting the sewing of the right edge *d* in FIG. 4.

It is mentioned in this connection that the sewing of the aforementioned right edge *d* is carried out continuously for an indefinite length of time while the forwarding claw 16 is positioned in the cut toothed portion *b*. Therefore, the subsequent or second manual step of resetting or switching the control knob 30 is carried out at the time when the sewing length of the right edge *b* has reached the desired length.

When the buttonhole operating shaft 20 is further rotated 30° by means of the knob 30, after the sewing of the bar lock stitches and at the front end *c* and the right edge sewing *d*, the three cams 3, 4, and 5 act at the same time the contact element 7 is pushed up once again, the amplitude changing lever 9 is changed to the position of the maximum amplitude, the contact elements 10 and 12 fall, the base line changing lever 11 is changed to the position of the left base line, and the forward changing rod 13 moves to the position where the forward feed is minimal or zero; and at the same time, the ratchet wheel 14 changes the position of engagement with the forwarding claw 16 from the cut tooth position *b* to the trailing (with respect to the direction of rotation) toothed surface portion *a*, thereby carrying out the lock sewing at the rear edge and the sewing of *e* as shown in FIG. 4.

When engagement between the aforementioned trailing surface part *a* and the forward claw 16 is broken, the rotation of the ratchet wheel 14 is terminated, as in the case of initiation of the aforementioned right edge sewing *d* and, at the same time, the cams 3 and 4 work, the contact elements 7 and 12 are made to fall, the amplitude changing lever 9 is changed to the position of a small amplitude, and the forward changing rod 13 is changed to the position where the amount of movement is medium in the forward direction, thereby effecting the sewing of left edge sewing F shown in FIG. 4. At the time when the length of the left edge F has reached the length of the aforementioned right edge sewing D, the operation of the sewing machine is terminated, thereby completing the sewing of one buttonhole.

This disclosed design, in which the sewing of one buttonhole is carried out by two manual setting operations as stated above, or by a two-touch operation by using the aforementioned construction, offers a buttonhole sewing device whose structure is simple in design and operation is easy.

While the invention has been described in connection with specific embodiments thereof, it is to be clearly understood that this is done only by way of example, and not as a limitation to the scope of the invention as set forth in the objects thereof and in the appended claims.

What is claimed is:

1. In a sewing machine having a needle bar, a feed mechanism, an upper shaft, a device for sewing of buttonholes comprising a control shaft journaled on the frame of the machine, an amplitude cam for controlling the amplitude of lateral oscillations of the needle, a base line cam for causing lateral needle oscillation to occur left, right, or centered with respect to the center needle position and a work feed control cam for determining the direction and rate of work feed, said cams each being fixed to said control shaft, a manually engageable control knob operably connected to said control shaft and adapted to determine two positions for said control shaft, follower means associated with each of said cams and connected to said needle bar and said feed mechanism for effecting appropriate operation of said needle bar and said feed mechanism to produce a buttonhole, a ratchet wheel fixed on said control shaft, a pawl operated by said upper sheet to advance said ratchet wheel from either of said two positions, one incremental rotational step for each rotation of said upper shaft, means for limiting the number of incremental rotational steps taken by said shaft from each of said two positions, means operable by said cams for sewing each end of the buttonhole to produce relatively little or no feed movement and a large amplitude during stitches formed while said shaft is being incrementally stepped from either of said two positions, means operable by said cams for sewing each side of the buttonhole by producing a moderate feed rate at the last step of said shaft from each of said positions and during subsequent stitching, means operable by said cams to cause sewing to continue in a first direction at the right side upon reaching the last step from one of said positions and during subsequent stitches and to cause sewing to continue in an opposite direction at the left side upon reaching the last step from the other of said positions and during subsequent stitches.

2. A device as set forth in claim 1, wherein said step limiting means comprises interruptions in a regular series of ratchet teeth on said wheel.

3. A device as set forth in claim 2, including a means for selectively rendering said device responsive to rotation of the upper shaft.

4. A device as set forth in claim 3, wherein said rendering device includes a second manually operable control knob.

5. A device as set forth in claim 4, wherein the second control knob is arranged to manually control the amplitude independent of operation of said device.

* * * * *